US008641394B2

(12) United States Patent
Yamada et al.

(10) Patent No.: US 8,641,394 B2
(45) Date of Patent: Feb. 4, 2014

(54) COMPRESSOR

(75) Inventors: Masahiro Yamada, Sakai (JP); Kazuhiko Matsukawa, Sakai (JP); Hiroyuki Yamaji, Sakai (JP); Satoshi Yamamoto, Sakai (JP); Yasuhiro Murakami, Sakai (JP); Tomoko Mizuguchi, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 366 days.

(21) Appl. No.: 12/867,780

(22) PCT Filed: Feb. 27, 2009

(86) PCT No.: PCT/JP2009/053730

§ 371 (c)(1),
(2), (4) Date: Aug. 16, 2010

(87) PCT Pub. No.: WO2009/107797

PCT Pub. Date: Sep. 3, 2009

(65) Prior Publication Data

US 2010/0329914 A1 Dec. 30, 2010

(30) Foreign Application Priority Data

Feb. 28, 2008 (JP) ..... 2008-047938
Feb. 27, 2009 (JP) ..... 2009-045513

(51) Int. Cl.
*F01C 1/02* (2006.01)
*F16N 7/36* (2006.01)

(52) U.S. Cl.
USPC ..... 418/55.6; 184/6.18; 418/94

(58) Field of Classification Search
USPC ..... 418/55.6
See application file for complete search history.

(56) References Cited

U.S. PATENT DOCUMENTS 4,623,306 A * 11/1986 Nakamura et al. ..... 418/55.6
5,133,651 A * 7/1992 Onoda et al. ..... 418/55.6
5,263,822 A * 11/1993 Fujio ..... 418/55.4
5,551,852 A * 9/1996 Saito et al. ..... 418/98
5,593,297 A * 1/1997 Nakajima et al. ..... 418/88

(Continued)

FOREIGN PATENT DOCUMENTS

| | | | | |
|---|---|---|---|---|
| JP | 49-21412 | U | | 2/1974 |
| JP | 58079684 | A | * | 5/1983 |
| JP | 59028090 | A | * | 2/1984 |
| JP | 62271987 | A | * | 11/1987 |
| JP | 63-268993 | A | | 11/1988 |
| JP | 06010864 | A | * | 1/1994 |
| JP | 09-32758 | A | | 2/1997 |
| JP | 09032758 | A | * | 2/1997 |
| JP | 10-153186 | A | | 6/1998 |
| JP | 10153186 | A | * | 6/1998 |
| JP | 10220369 | A | * | 8/1998 |
| JP | 11-182473 | A | | 7/1999 |
| JP | 2003-129967 | A | | 5/2003 |
| JP | 2003-293954 | A | | 10/2003 |
| JP | 2007-224798 | A | | 9/2007 |

OTHER PUBLICATIONS

International Preliminary Report of corresponding PCT Application No. PCT/JP2009/053730.

*Primary Examiner* — Thomas Denion
*Assistant Examiner* — Jessica Kebea
(74) *Attorney, Agent, or Firm* — Global IP Counselors

(57) ABSTRACT

A compressor is configured to compress a refrigerant and use a lubricating oil. The compressor includes a compression mechanism configured to compress the refrigerant, a driving shaft configured to rotate about a rotation axis in order to drive the compression mechanism, a slide bearing slidably supporting the driving shaft, a first surface fixed to the driving shaft and intersecting with a line arranged in parallel to the rotation axis, a second surface facially abutted to the first surface, and a recovery space formed in the compressor. The recovery space is configured and arranged to recover the lubricating oil leaking out of bottom ends of sliding surfaces of the slide bearing and the driving shaft. The first surface and the second surface respectively continue to surfaces forming the recovery space.

7 Claims, 18 Drawing Sheets

(56) References Cited

U.S. PATENT DOCUMENTS

| | | | | |
|---|---|---|---|---|
| 5,660,539 | A * | 8/1997 | Matsunaga et al. | 418/55.6 |
| 6,413,060 | B1 * | 7/2002 | Tarng et al. | 418/55.6 |
| 7,214,044 | B2 * | 5/2007 | Uekawa et al. | 418/55.6 |
| 2005/0069443 | A1 | 3/2005 | Uekawa et al. | |
| 2008/0056632 | A1 * | 3/2008 | Yoshimura et al. | 384/400 |
| 2009/0010776 | A1 * | 1/2009 | Tsuchiya et al. | 417/410.5 |
| 2011/0020161 | A1 * | 1/2011 | Tsuchiya et al. | 418/55.1 |

* cited by examiner

COMPRESSOR

CROSS-REFERENCE TO RELATED APPLICATIONS

This U.S. National stage application claims priority under 35 U.S.C. §119(a) to Japanese Patent Application No. 2008-047938, filed in Japan on Feb. 28, 2008, the entire contents of which are hereby incorporated herein by reference.

TECHNICAL FIELD

The present invention relates to a compressor, more specifically, to a compressor using a lubricating oil.

BACKGROUND ART

Some compressors (e.g., scroll compressors) include a driving shaft configured to drive a compression mechanism and a slide bearing supporting the driving shaft for allowing the driving shaft to slide therealong. In the well-known compressors, a lubricating oil is configured to be supplied to the sliding surfaces of the driving shaft and the slide bearing for reducing friction to be produced therebetween.

In same cases, however, the lubricating oil supplied to the sliding surfaces leaks from the bottom ends of the sliding surfaces. Further, the leaked lubricating oil is partially discharged out of the compressor together with a refrigerant. When a large quantity of the lubricating oil leaks out of the compressor, this results in reduction in a quantity of the lubricating oil contained in the compressor and troubles of the compressor. For example, leakage of the lubricating oil results in a large friction between the driving shaft and the slide bearing. Therefore, the driving shaft and the slide bearing are both abraded because of the friction produced therebetween.

In view of the drawback, the following compressor-related technology has been proposed. Specifically, a compressor houses a circulation path in the interior thereof for circulating the lubricating oil. A driving shaft includes an annular groove circumferentially extended thereon about a rotation axis thereof. A fixation member is configured to fix the slide bearing and includes an oil path. The oil path allows the lubricating oil, accumulated in the annular groove, to flow to the circulation path. For example, Japanese Laid-open Patent Publication No. 2003-293954 describes the technology.

The aforementioned technology results in reduction in oil-film pressure at the annular groove. The lubricating oil on the sliding surfaces thereby flows into the annular groove. The lubricating oil in the annular groove easily flows to the circulation path through the oil path.

SUMMARY

Technical Problem

Even the compressor described in Japanese Laid-open Patent Publication No. 2003-293954, however, may cause leakage of the lubricating oil from the sliding surfaces. This may cause troubles of the compressor thereafter.

Leakage of the lubricating oil can be prevented by, for instance, producing a long distance from the annular groove to the bottom ends of the sliding surfaces. However, this is not fully preferable because the sliding bearing is required to be vertically elongated. Alternatively, leakage of the lubricating oil can be prevented by deeply forming the annular groove on the driving shaft. However, this is not fully preferable because strength of the driving shaft is reduced by the structure.

The present invention is produced in view of the above. The present invention addresses a need for effectively preventing leakage of the lubricating oil from the sliding surfaces.

Solution to Problem

A compressor according to a first aspect of the present invention is configured to compress a refrigerant using a lubricating oil. The compressor includes a compression mechanism, a driving shaft, a slide bearing, a first surface, and a second surface. The compression mechanism is configured to compress the refrigerant. The driving shaft is configured to drive the compression mechanism. The driving shaft is further configured to rotate about a rotation axis. The slide bearing supports the driving shaft for allowing the driving shaft to slide therealong. The first surface intersects with a line arranged in parallel to the rotation axis. The first surface is fixed to the driving shaft. The second surface is facially abutted to the first surface from bottom. A recovery space is formed in the compressor for recovering the lubricating oil leaking out of bottom ends of sliding surfaces of the slide bearing and the driving shaft. The first surface and the second surface respectively continue to surfaces forming the recovery space.

A compressor according to a second aspect of the present invention relates to the compressor according to the first aspect of the present invention. In the compressor, the driving shaft includes a portion protruded towards the rotation axis in a radial direction. Further, the first surface forms at least a part of a bottom surface of the protruded portion of the driving shaft.

A compressor according to a third aspect of the present invention relates to the compressor according to one of the first and second aspects of the present invention. The compressor further includes a fixation member fixing the slide bearing thereon. The fixation member includes a portion protruded towards the driving shaft. The portion is positioned below a part of the fixation member where the slide bearing is fixed. The second surface forms at least a part of a top surface of the protruded portion of the fixation member.

A compressor according to a fourth aspect of the present invention relates to the compressor according to one of the first and second aspects of the present invention. The compressor further includes a fixation member and a plate. The fixation member fixes the slide bearing thereon. The plate is fixed to the fixation member while being positioned below a part of the fixation member where the slide bearing is fixed. Further, the second surface forms at least a part of a top surface of the plate.

A compressor according to a fifth aspect of the present invention relates to the compressor according to one of the first to fourth aspects of the present invention. The compressor further includes a fixation member fixing the slide bearing thereon. In the compressor, a circulation path is formed for circulating the lubricating oil therein. In the compressor, the recovery space includes a first space and a second space. The first space is formed by surfaces when the driving shaft is supported by the slide bearing. The surfaces include: a lateral surface of the driving shaft, which continues to the first surface; a bottom surface of the slide bearing; a surface continuing to the second surface; and a surface of the fixation member, positioned close to the driving shaft. The second space connects the first space and the circulation path.

A compressor according to a sixth aspect of the present invention relates to the compressor according to the fifth aspect of the present invention. In the compressor, the surface of the fixation member, positioned close to the driving shaft, is further retracted away from the driving shaft than a surface fixing the slide bearing thereon is.

A compressor according to a seventh aspect of the present invention relates to the compressor according to the fifth aspect of the present invention. In the compressor, the second space is formed by an annular groove and a connection path. The annular groove is opposed to a part or entirety of the slide bearing through a wall. The connection path penetrates the wall for connecting the first space and the second space.

Advantageous Effects of Invention

According to the compressor of the first aspect of the present invention, the first surface fixed to the driving shaft is supported by the second surface. The first surface is thereby pressed onto the second surface due to the weight of the driving shaft. Accordingly, it is almost impossible for the lubricating oil to enter a clearance between the first and second surfaces continuing to the surfaces forming the recovery space. Consequently, it is possible to efficiently prevent the lubricating oil, flowing into the recover space, from leaking out through the clearance between the first and second surfaces. Further, the first surface is pressed onto the second surface due to the weight of the driving shaft even when the compressor is under deactivation. Therefore, the compressor can contain the lubricating oil in the recovery space. Consequently, the compressor can form an initial oil film between the driving shaft and the slide bearing using the lubricating oil contained in the recovery space when the compressor is activated. Further, the compressor can prevent a gas blow caused when oil supply is delayed.

According to the compressor of the second aspect of the present invention, the driving shaft includes the protruded portion. Therefore, reduction in strength of the driving shaft can be prevented. Simultaneously, the bottom surface of the protruded portion can be supported by the second surface from bottom.

According to the compressor of the third aspect of the present invention, the first surface can be supported by the protruded portion of the fixation member from bottom.

According to the compressor of the fourth aspect of the present invention, the first surface can be supported by the top surface of the plate from bottom. Further, the compressor can be simply manufactured with a simple structure that the plate is attached to the fixation member.

According to the compressor of the fifth aspect of the present invention, oil-film pressure is reduced in the first space. The lubricating oil, flowing between the sliding surfaces, thereby flows into the first space. The lubricating oil, flown into the first space, is subsequently guided to the circulation path through the second space. Leakage of the lubricating oil can be thereby prevented. Further, the first space can be formed by arrangement of the driving shaft and the slide bearing without processing the driving shaft and the fixation member. Therefore, the compressor can be simply manufactured.

Further, the lubricating oil, flowing between the sliding surfaces, is configured to flow into the circulation path. Therefore, frictional heat generated between the sliding surfaces can be relieved by the lubricating oil as a heat reliever.

According to the compressor of the sixth aspect of the present invention, the first space is expanded. Therefore, a quantity of the lubricating oil recoverable in the first space can be increased.

According to the compressor of the seventh aspect of the present invention, the annular groove functions as a lubricating oil circulation path, whereas the wall functions as an elastic bearing. Therefore, the compressor can achieve prevention of non-uniform/partial contact of the driving shaft with respect to the slide bearing in addition to the advantageous effect of the compressor according to the fifth aspect of the present invention.

DETAILED DESCRIPTION OF EMBODIMENT(S)

1. Scroll Compressor

Figure 1:
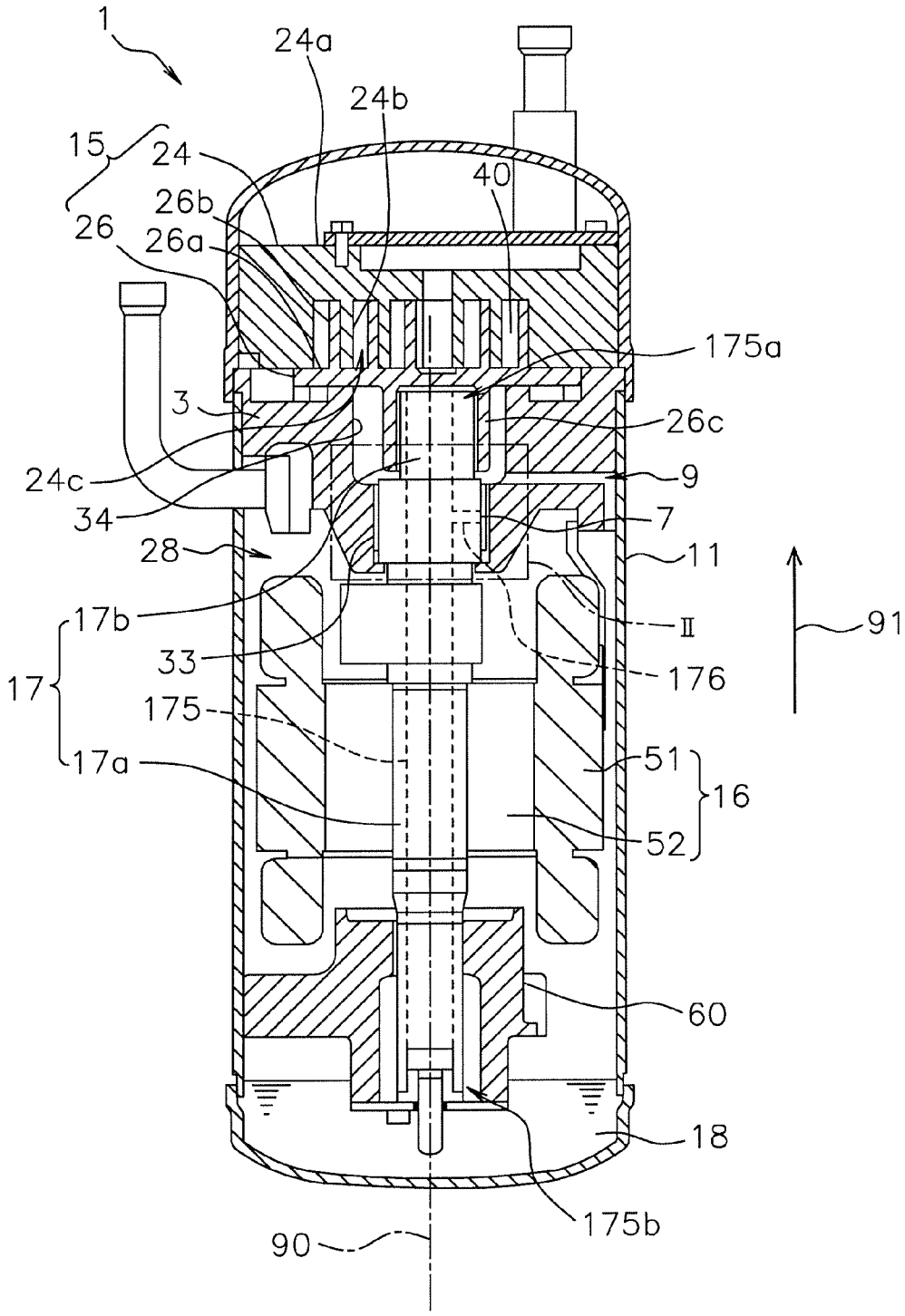
FIG. 1 is a schematic view of a scroll compressor according to an embodiment of the present invention.
Figure 2:
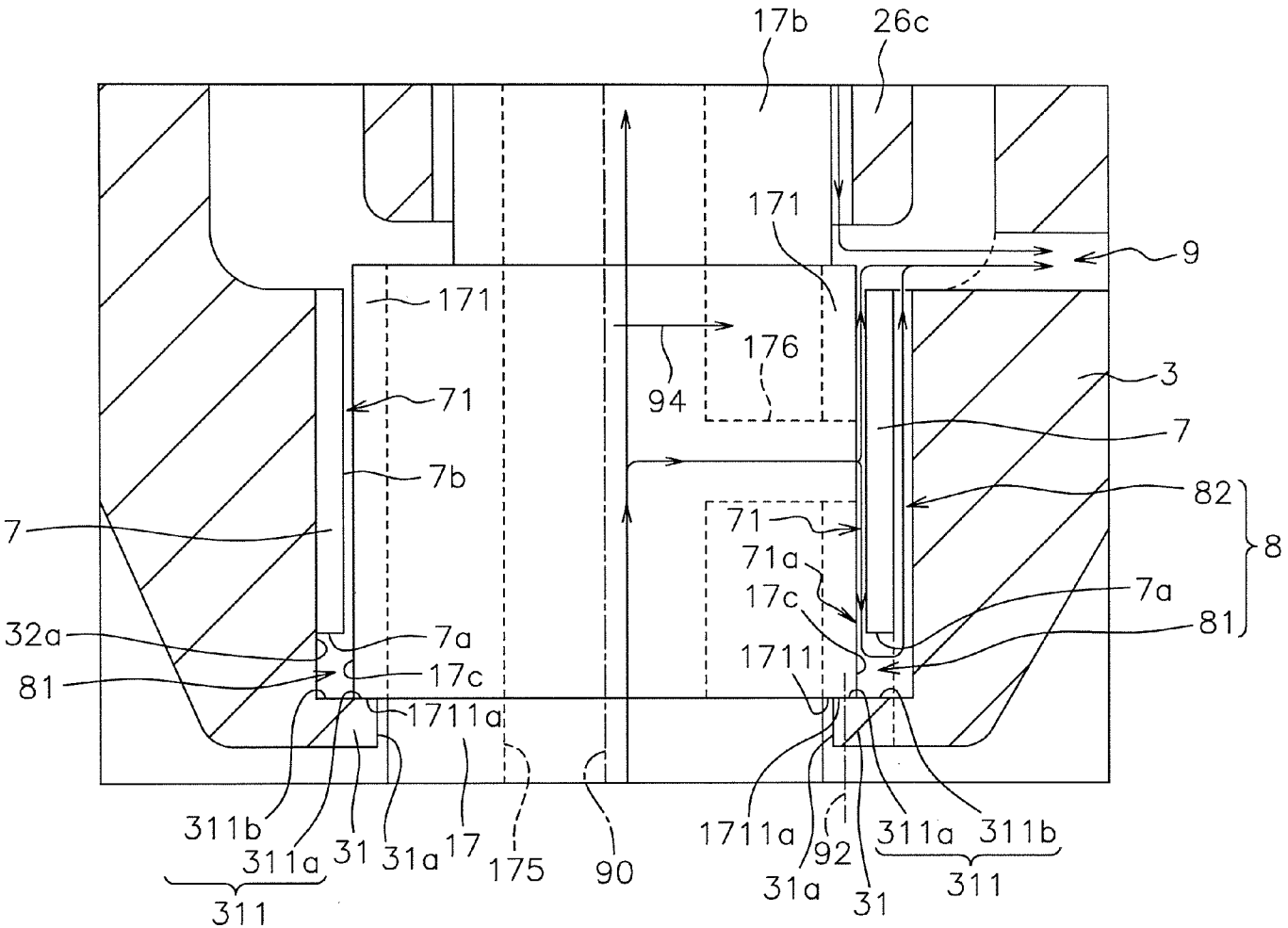
FIG. 2 is an enlarged view of an area II illustrated in FIG. 1.
Figure 6:
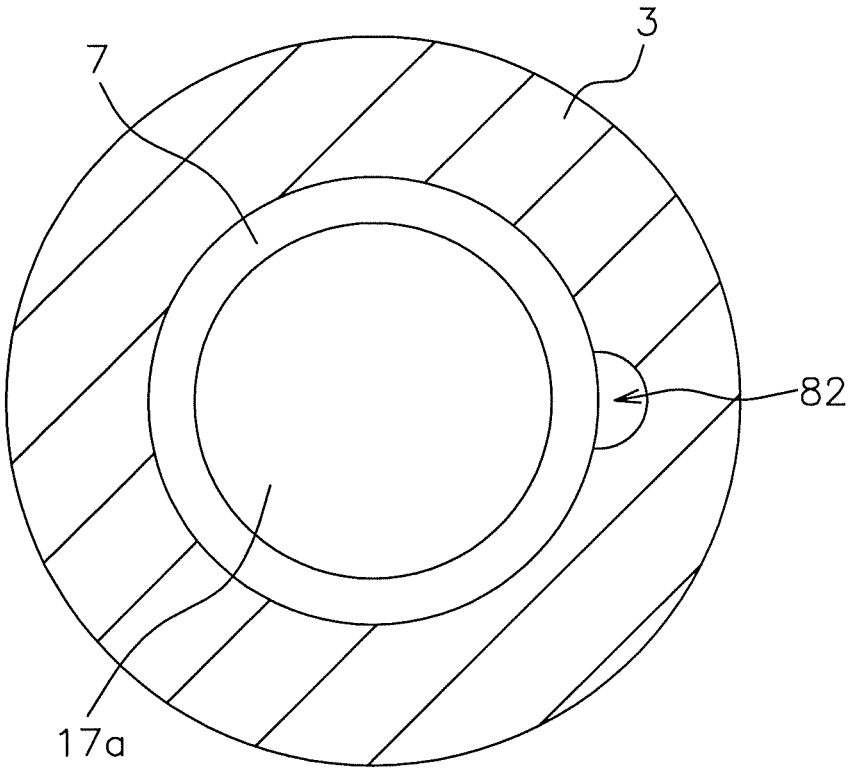
FIG. 6 is a transverse cross-sectional view of the area II illustrated in FIG. 1.

FIG. 1 is a schematic view of a scroll compressor 1 as a compressor according to an embodiment of the present invention. FIG. 2 is an enlarged view of an area II illustrated in FIG. 1. FIG. 6 is a transverse cross-sectional view of the area II. It should be noted that FIG. 1 depicts a direction 91. A side directed by the head of an arrow of the direction 91 is hereinafter referred to as "a top side", whereas the opposite side of the top side is hereinafter referred to as "a bottom side".

The scroll compressor 1 includes a housing 11, a compression mechanism 15, a motor 16, a crank shaft 17, a slide bearing 7, a bearing 60, and a fixation member 3. The respective components will be hereinafter explained.

<Housing>

The housing 11 is a tubular member having closed top and bottom ends. The housing 11 is extended along the direction 91. The housing 11 houses the compression mechanism 15, the motor 16, the crank shaft 17, the slide bearing 7, the bearing 60, and the fixation member 3 in the interior thereof. In addition, the housing 11 includes a recovery space 8 in the interior thereof for recovering lubricating oil therein (see FIG. 2). The recovery space 8 will be explained in detail in the following section "3. Recovery of Lubricating Oil".

<Motor>

The motor 16 includes a stator 51 and a rotor 52. The stator 51 is an annular member fixed to the housing 11. The rotor 52 is configured to rotate about a rotation axis 90. The rotor 52 is disposed on the inner peripheral side of the stator 51 while being opposed to the stator 51 through an air gap. It should be noted in FIG. 1 that the direction 91 is identical to a direction arranged along the rotation axis 90.

<Crank Shaft>

The crank shaft 17 is extended along the direction 91. The crank shaft 17 includes a main shaft 17*a* and an eccentric part 17*b*. The main shaft 17*a* is a part configured to rotate about the rotation axis 90. The main shaft 17*a* is connected to the rotor 52. A lower portion of the main shaft 17*a* is slidably supported by the bearing 60.

The main shaft 17*a* includes a portion 171 protruded in a radial direction 94 with respect to the rotation axis 90 (see FIG. 2). The protruded portion 171 has a bottom surface 1711. In FIG. 2, the bottom surface 1711 is horizontally extended.

The eccentric part 17*b* is disposed eccentric to the rotation axis 90. The eccentric part 17*b* is connected to the upper side of the main shaft 17*a*.

It should be noted that the compression mechanism 15 is configured to be driven in response to rotation of the crank shaft 17, as described below. Therefore, the crank shaft 17 can be regarded as a driving shaft configured to drive the compression mechanism 15.

<Fixation Member>

As specifically illustrated in FIG. 1, the fixation member 3 is a housing member fitted and fixed to the inside of the housing 11 without clearance. The fixation member 3 is herein fitted to the housing 11 by means of a method such as press-insertion or heat shrinkage fitting. Alternatively, the fixation member 3 may be fitted to the housing 11 through a sealing member.

The fixation member 3 includes a recess 34 and an aperture 33 in the vicinity of the rotation axis 90. The recess 34 is upwardly opened, whereas the aperture 33 penetrates through the fixation member 3 downwardly from the recess 34. The recess 34 houses the eccentric part 17*b* of the crank shaft 17.

The fixation member 3 includes a portion 31 (see FIG. 2) positioned below a part of the fixation member 3 where the slide bearing 7 described below is attached. The portion 31 is protruded towards the crank shaft 17. An end surface 31*a* of the protruded portion 31 is positioned closer to the rotation axis 90 than a surface 7*b* (i.e., a surface positioned close to the crank shaft 17) of the slide bearing 7 fixed to the fixation member 3.

The protruded portion 31 includes a top surface 311. A portion 311*a* of the top surface 311 is facially abutted to a portion 1711*a* of the bottom surface 1711 of the main shaft 17*a* from bottom.

The aforementioned content can be regarded as follows based on the understanding that the facially abutted portions of the bottom surface 1711 and the top surface 311 correspond to first and second surfaces, respectively. In short, the scroll compressor 1 includes a first surface 1711*a* and a second surface 311*a*. The first surface is fixed to the crank shaft 17, whereas the second surface 311*a* is facially abutted to the first surface 1711*a* from bottom.

<Slide Bearing>

The slide bearing 7 is fixed to the inner peripheral surface of the aperture 33. The slide bearing 7 supports the main shaft 17*a* of the crank shaft 17 for allowing the main shaft 17*a* to slide therealong under a condition that the main shaft 17*a* penetrates through the aperture 33.

<Compression Mechanism>

The compression mechanism 15 includes a stable scroll 24 and a movable scroll 26. The compression mechanism 15 is configured to compress a refrigerant. For example, it is herein possible to use a refrigerant containing one of the following as a main constituent thereof: chlorofluorocarbon (CFC); hydrochlorofluorocarbon (HCFC); hydrofluorocarbon (HFC); and carbon dioxide.

The stable scroll 24 includes a head 24*a* and a compression member 24*b*. The compression member 24*b* is coupled to the bottom side of the head 24*a*. The compression member 24*b* is extended in a helical shape. A groove 24*c* is formed between the helical patterns of the compression member 24*b*.

The movable scroll 26 includes a head 26*a*, a compression member 26*b*, and a bearing 26*c*. The compression member 26*b* is coupled to the top side of the head 26*a*. The compression member 26*b* is extended in a helical shape.

The compression member 26*b* is contained in the groove 24*c* of the stable scroll 24. The compression mechanism 15 includes a space 40 between the compression member 24*b* and the compression member 26*b*. The space 40 is sealed by the heads 24*a*, 26*a*. Accordingly, the space 40 is allowed to be used as a compression chamber.

The bearing 26*c* is coupled to the bottom side of the head 26*a*. The bearing 26*c* supports the eccentric part 17*b* of the crank shaft 17 for allowing the eccentric part 17*b* to slide therealong. The movable scroll 26 is configured to orbit about the rotation axis 90 when the eccentric part 17*b* rotates about the rotation axis 90. In other words, the compression mechanism 15 is configured to be driven in conjunction with rotation of the crank shaft 17.

2. Flow of Lubricating Oil

A lubricating oil is used for the aforementioned scroll compressor 1 in order to reduce mechanical friction to be caused in the interior of the scroll compressor 1. The lubricating oil is accumulated in a reservoir 18 disposed in the scroll compressor 1. Flow of the lubricating oil will be hereinafter explained with reference to FIGS. 1 and 2. It should be noted that FIG. 2 illustrates the flow of the lubricating oil with arrows.

The crank shaft 17 includes a through hole 175 and a transverse hole 176. The through hole 175 penetrates the crank shaft 17 from a bottom end 175*b* to a top end 175*a* in a predetermined direction arranged along the direction 91. The transverse hole 176 is extended from the through hole 175 to sliding surfaces 71 of the main shaft 17*a* and the slide bearing 7 (see FIG. 2). The transverse hole 176 is opened to the sliding surfaces 71, and the outlet thereof is positioned in the vicinity of the center of the sliding surfaces 71 in the direction 91.

The through hole 175 is configured to function as a centrifugal pump in conjunction with rotation of the crank shaft 17. Specifically, the lubricating oil accumulated in the reservoir 18 is drawn from the bottom end 175*b* to the top end 175*a* of the crank shaft 17 through the through hole 175 in driving of the scroll compressor 1.

The scroll compressor 1 includes a path 9 allowing the drawn lubricating oil to flow back to the reservoir 18. It should be noted in FIG. 1 that the fixation member 3 includes the path 9. When being drawn up to the top end 175*a*, the lubricating oil flows between the sliding surfaces of the eccentric part 17*b* and the bearing 26*c* from top to bottom and subsequently flows back to the reservoir 18 through the path 9 (see FIG. 2).

Thus, the lubricating oil can be circulated. Simultaneously, friction can be reduced between the eccentric part 17*b* and the bearing 26*c*. It should be noted the path 9 can be regarded as a circulation path in terms of circulation of the lubricating oil using the path 9.

Further, the drawn lubricating oil flows into a clearance between the sliding surfaces 71 of the crank shaft 17 and the slide bearing 7 through the transverse hole 176. When flowing into the clearance between the sliding surfaces 71, the lubricating oil partially flows upwards and subsequently flows back to the reservoir 18 through the path 9 (see FIG. 2). The remaining lubricating oil flows downwards and subsequently flows out of bottom ends 71*a* of the sliding surfaces 71 of the slide bearing 7 and the crank shaft 17 (see FIG. 2).

3. Recovery of Lubricating Oil

The lubricating oil is recovered by the recovery space 8 after flowing out of the bottom ends 71*a* of the sliding surfaces 71. Specifically, the recovery space 8 includes a space 81 and a path 82 (see FIGS. 2 and 6).

The space 81 is formed by four surfaces under a condition that the slide bearing 7 supports the crank shaft 17. The first surface corresponds to a surface 17*c*. The surface 17*c* is a part of the lateral surface of the crank shaft 17 and continues to the portion 1711*a* (a first surface) of the bottom surface 1711 of the main shaft 17*a*. The second surface corresponds to a bottom surface 7*a* of the slide bearing 7. The third surface corresponds to a portion 311*b*. The portion 311*b* is different from the portion 311*a* (a second surface) of the top surface 311 of the fixation member 3. It should be noted that the portion 311*b* of the top surface 311 can be regarded as a surface continuing to the portion 311*a* (the second surface). The fourth surface corresponds to a surface 32*a*. The surface 32*a* is a part of the surface (i.e., a surface close to the crank shaft 17) of the fixation member 3. The surface 32*a* is positioned between the top surface 311 and the bottom surface 7*a*.

Based on the aforementioned contents of the first and third surfaces, the portion 1711*a* (the first surface) of the bottom surface 1711 of the main shaft 17*a* and the portion 311*a* (the second surface) of the top surface 311 of the fixation member 3 can be respectively regarded as surfaces continuing to the surfaces forming the recovery space 8.

The path 82 connects the space 81 and the path 9. Specifically, the path 82 is vertically extended along the slide bearing 7 from the space 81 to the path 9 while being disposed on the opposite side of the crank shaft 17 through the slide bearing 7.

It should be noted that the space 81 and the path 82 can be respectively regarded as a first space and a second space included in the recovery space 8.

With the recovery space 8, the lubricating oil, flowing between the sliding surfaces 71, flows into the space 81 because the oil-film pressure is reduced in the space 81. The lubricating oil is guided to the path 9 through the path 82 after flowing into the space 81. Leakage of the lubricating oil can be thereby prevented. Further, the space 81 can be formed by arrangement of the crank shaft 17 and the slide bearing 7 without processing the crank shaft 17 and the fixation member 3. The scroll compressor 1 can be thereby simply manufactured.

Yet further, the lubricating oil, flowing between the sliding surfaces 71, is configured to flow into the path 9. Frictional heat generated between the sliding surfaces 71 can be thereby relieved with the lubricating oil as a heat reliever.

4. Leakage Prevention of Lubricating Oil

According to the aforementioned scroll compressor 1, the portion 1711*a* (the first surface) of the bottom surface 1711 fixed to the crank shaft 17 is supported by the portion 311*a* (the second surface) of the top surface 311 of the fixation member 3 from bottom. Therefore, the first surface 1711*a* is pressed onto the second surface 311*a* due to the weight of the crank shaft 17.

Therefore, it is almost impossible for the lubricating oil to flow into a clearance between the first and second surfaces 1711*a*, 311*a* continuing to the surfaces forming the recovery space 8. Consequently, it is possible to efficiently prevent the lubricating oil, flowing into the recovery space 8, from leaking out through a clearance between the first surface 1711*a* and the second surface 311*a*.

5. Modifications

<Modification 1>

In the aforementioned scroll compressor 1, the portion 1711*a* (the first surface) of the bottom surface 1711 of the main shaft 17*a* is horizontally extended (see FIG. 1). The structure of the portion 1711*a* is not necessarily limited to this. The first surface 1711*a* may be arbitrarily formed as long as the first surface 1711*a* intersects with a line 92 arranged in parallel to the rotation axis 90 (see FIG. 2). The scroll compressor of the present modification can efficiently prevent leakage of the lubricating oil, similarly to the aforementioned scroll compressor 1.

It should be noted in the present modification that the portion 311*a* (the second surface) of the top surface 311 of the fixation member 3 is facially abutted to the first surface 1711*a* from bottom.

<Modification 2>

Figure 3:
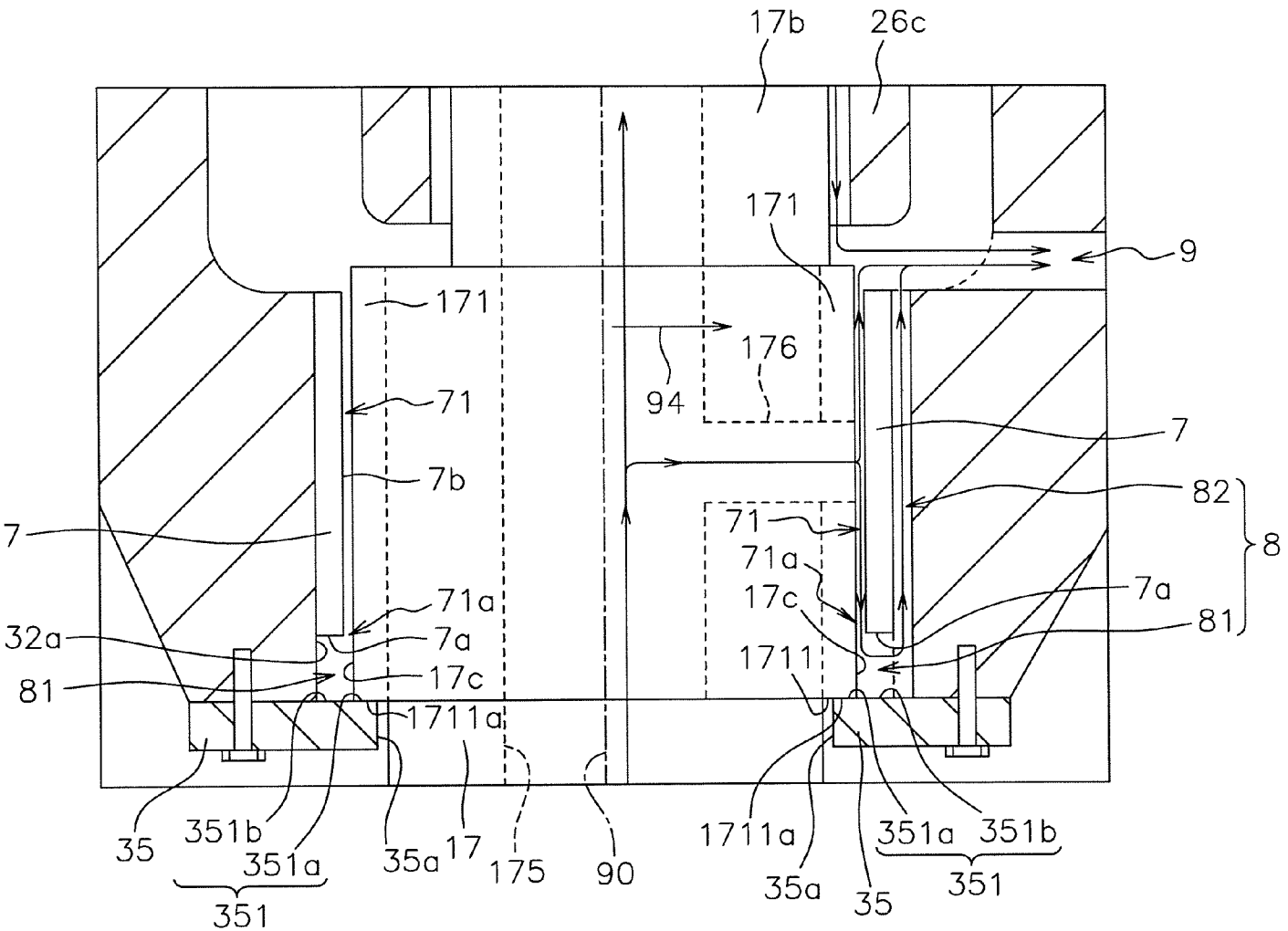
FIG. 3 is a schematic view of a scroll compressor according to a modification 2.

FIG. 3 is a schematic view of a scroll compressor 1 according to a modification of the aforementioned embodiment. In the present modification, a plate 35 is used instead of the protruded portion 31 of the fixation member 3.

The plate 35 is fixed to the fixation member 3. The plate 35 is positioned below a part of the fixation member 3 where the slide bearing 7 is fixed. An inner peripheral surface 35*a* of the plate 35 is protruded towards the crank shaft 17. The inner peripheral surface 35*a* is disposed closer to the crank shaft 17 than the surface 32*a* (i.e., a surface close to the crank shaft 17) of the fixation member 3 and a surface 7*b* (i.e., a surface close to the crank shaft 17) of the slide bearing 7 fixed to the fixation member 3 are.

Further, a portion 351*a* of a top surface 351 of the plate 35 is facially abutted to the portion 1711*a* (the first surface) of the bottom surface 1711 of the main shaft 17*a* from bottom. It should be noted that the portion 351*a* of the top surface 351 can be regarded as the second surface.

A portion 351*b* of the top surface 351 is a portion different from the portion 351*a*. The portion 351*b* is one of the surfaces forming the recovery space 8. It should be noted that the portion 351*b* corresponds to the third surface of the four surfaces forming the aforementioned recovery space 8.

The scroll compressor 1 of the present modification can efficiently prevent leakage of the lubricating oil similarly to the aforementioned scroll compressor 1 (see FIGS. 1 and 2).

Further, the scroll compressor 1 can be simply manufactured due to a simple structure that the plate 35 is attached to the fixation member 3.

<Modification 3>

Figure 4:
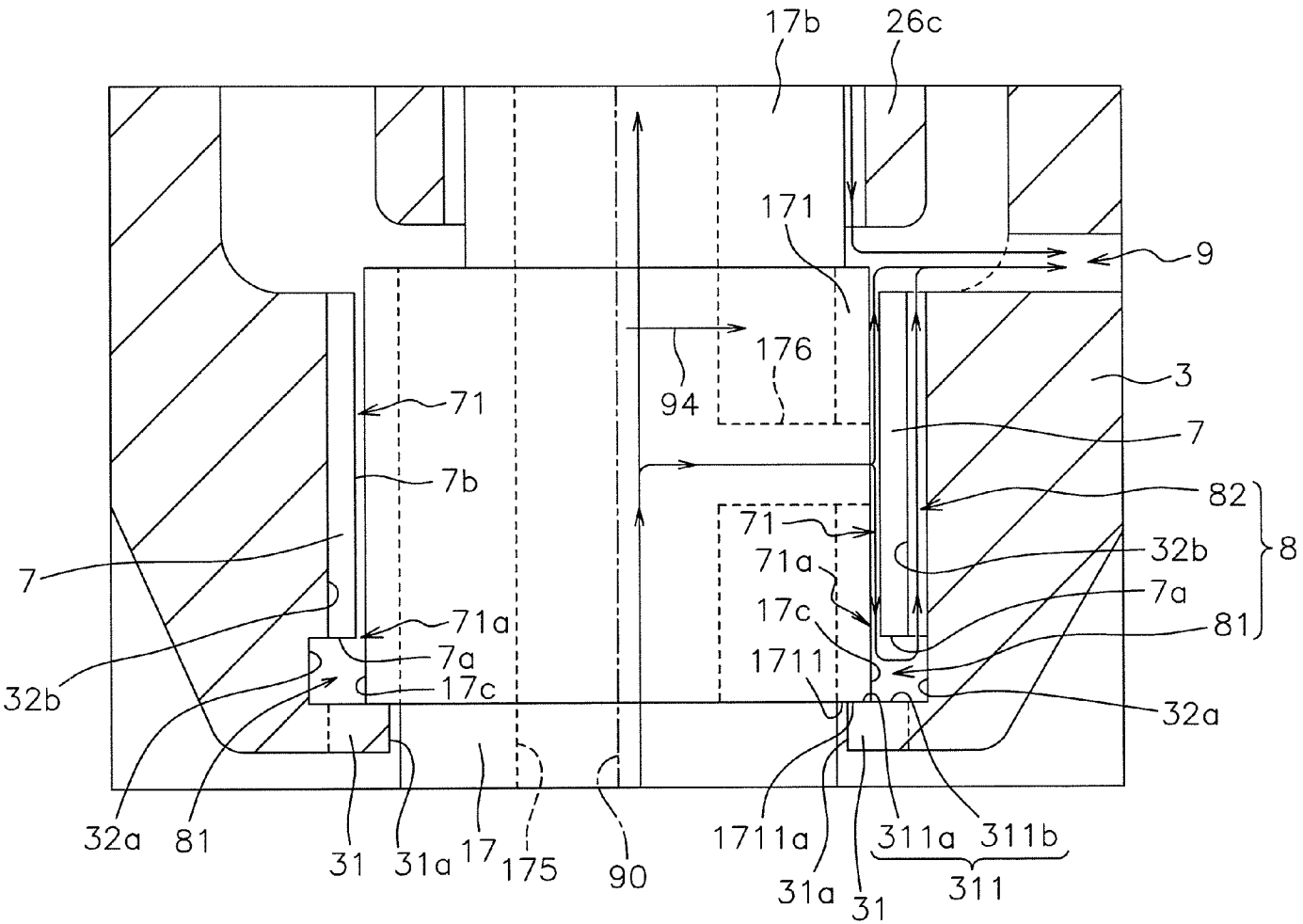
FIG. 4 is a schematic view of a scroll compressor according to a modification 3.
Figure 7:
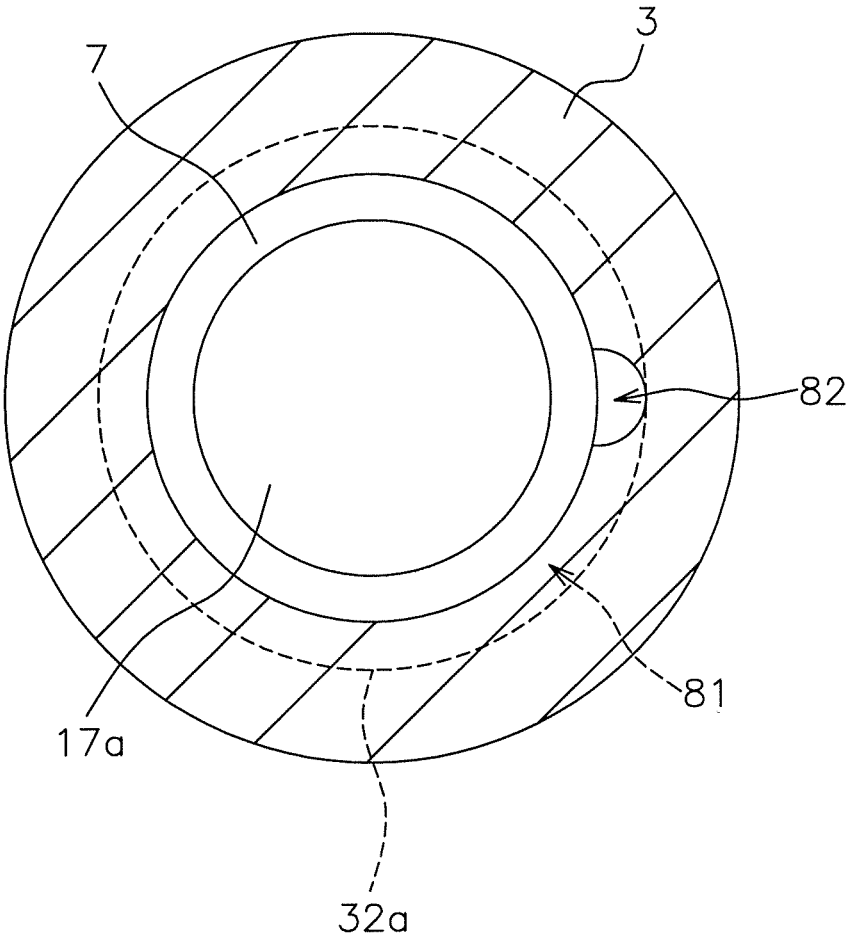
FIG. 7 is a transverse cross-sectional view of an area II illustrated in FIG. 4.

FIG. 4 is a schematic view of a scroll compressor 1 according to a modification of the aforementioned embodiment. FIG. 7 is a transverse cross-sectional view of an area II illustrated in FIG. 4. In the present modification, the surface 32*a* of the fixation member 3, forming a part of the recovery space 8, is entirely further retracted away from the crank shaft 17 than the surface 32*b* (i.e., a surface close to the crank shaft 17) of the fixation member 3 where the slide bearing 7 is fixed is.

According to the scroll compressor 1 of the present modification, the space 81 of the recovery space 8 is expanded. A volume of the lubricating oil recoverable in the space 81 can be thereby increased.

<Modification 4>

Figure 5:
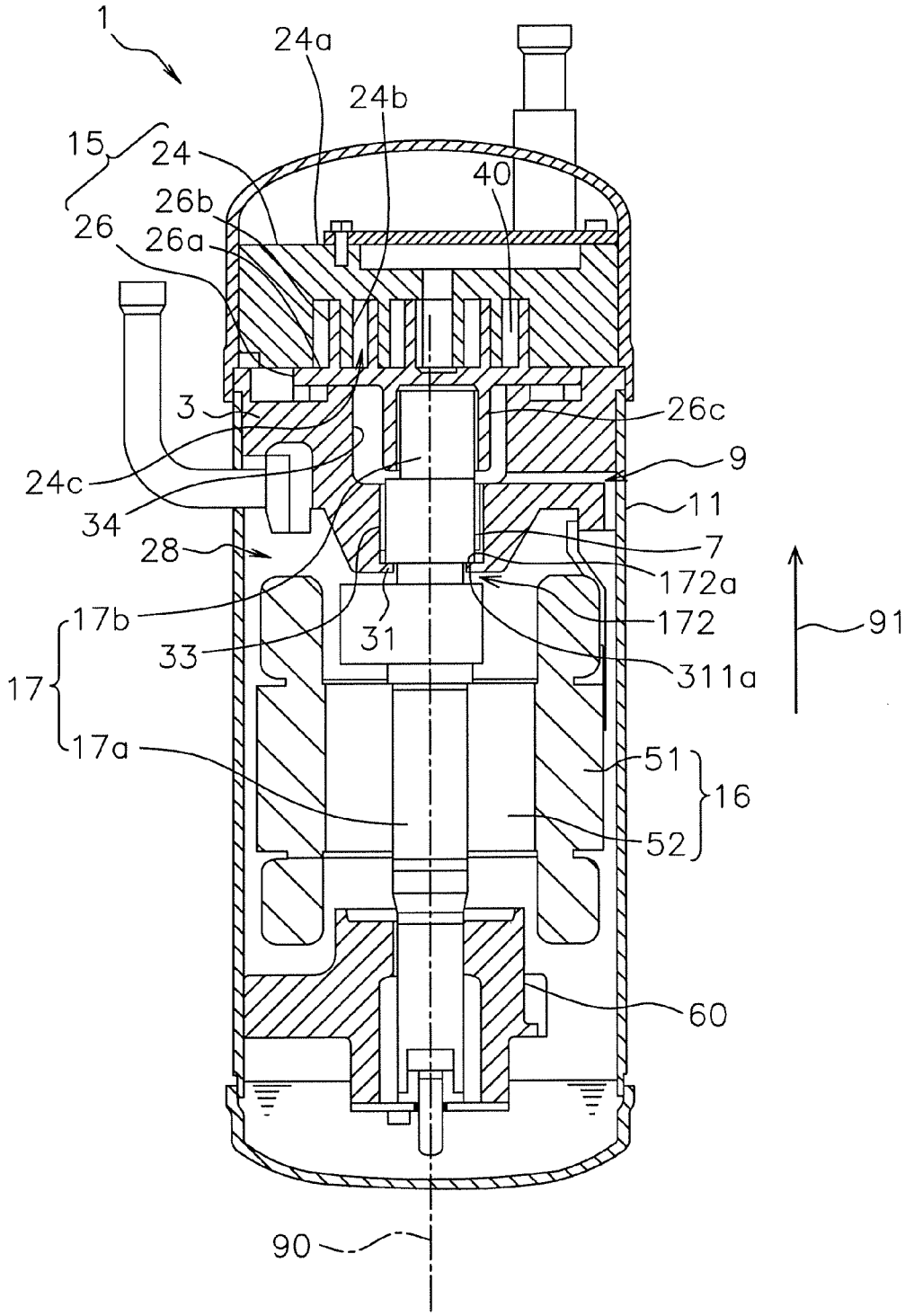
FIG. 5 is a schematic view of a scroll compressor according to a modification 4.

FIG. 5 is a schematic view of a scroll compressor 1 according to a modification of the aforementioned embodiment. In the present modification, the main shaft 17*a* includes a recess 172 recessed towards the rotation axis 90. A second surface 311*a* is herein facially abutted to and supports a portion 172*a* as the first surface of a top surface of the recess 172 from bottom.

The scroll compressor 1 according to the present modification can efficiently prevent leakage of the lubricating oil similarly to the aforementioned scroll compressor 1 (see FIG. 1). In terms of prevention of reduction in strength of the crank shaft 17, it is preferable to form the protruded portion 171 in the main shaft 17*a* of the crank shaft 17 as formed in the scroll compressor 1 illustrated in FIG. 1.

<Modification 5>

Figure 8:
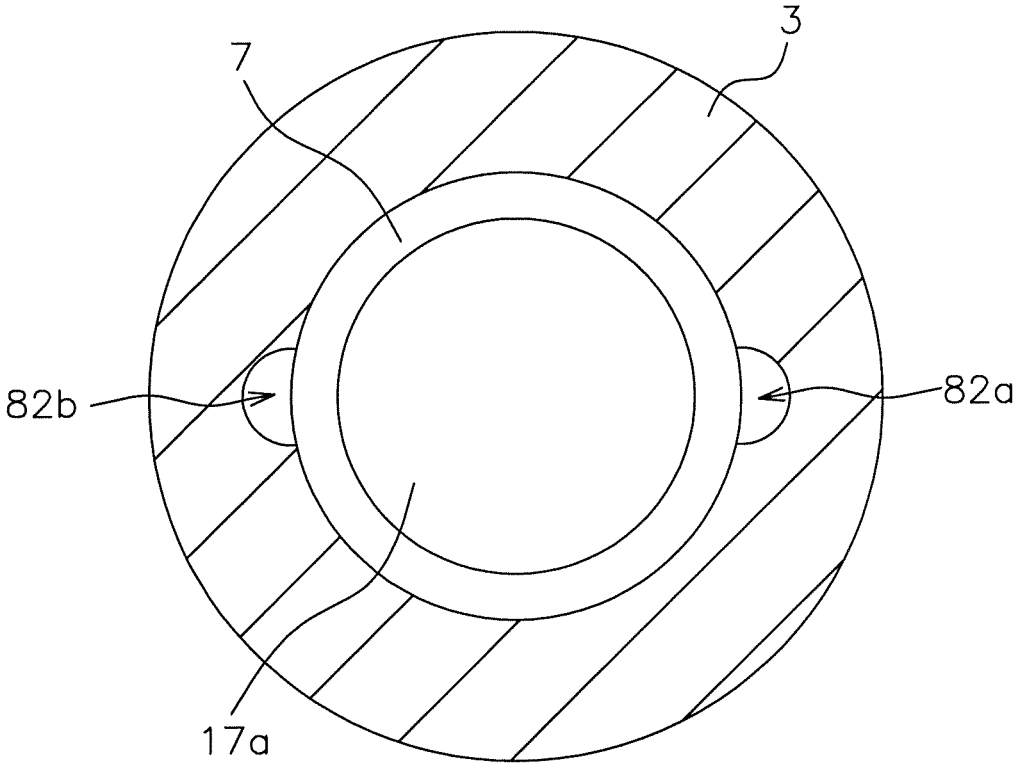
FIG. 8 is a transverse cross-sectional view of an area II of a scroll compressor according to a modification 5.
Figure 9:
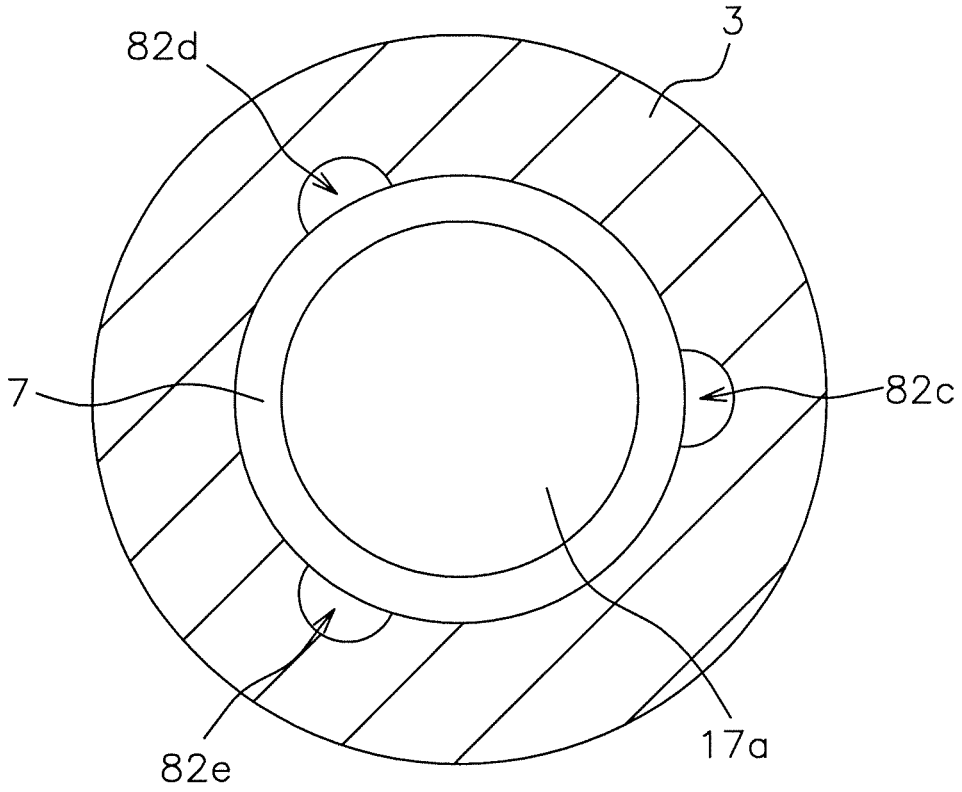
FIG. 9 is a transverse cross-sectional view of the area II of the scroll compressor according to the modification 5.

The aforementioned scroll compressor 1 includes only a single path, i.e., the path 82 (see FIG. 6). However, two paths 82*a*, 82*b* may be formed as illustrated in FIG. 8. In this case, the paths 82*a*, 82*b* are opposed to each other through the rotation axis 90. Alternatively, three paths 82*c*, 82*d*, 82*e* may be formed about the slide bearing 7 at equal intervals, as illustrated in FIG. 9. Yet alternatively, three or more paths may be formed about the slide bearing 7 at equal or unequal intervals.

Figure 10:
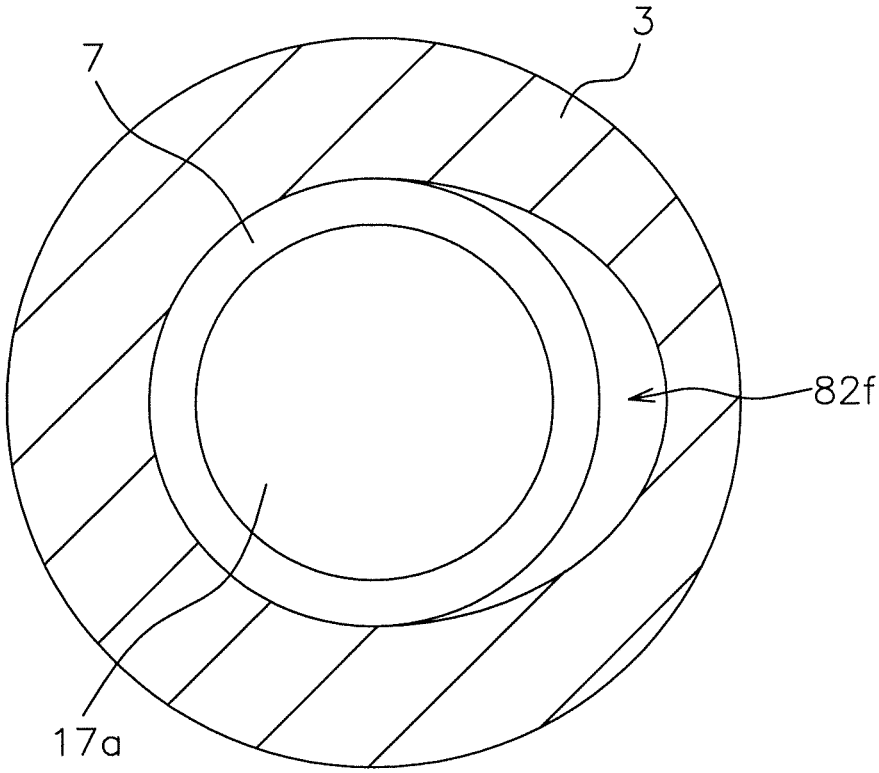
FIG. 10 is a transverse cross-sectional view of the area II of the scroll compressor according to the modification 5.
Figure 11:
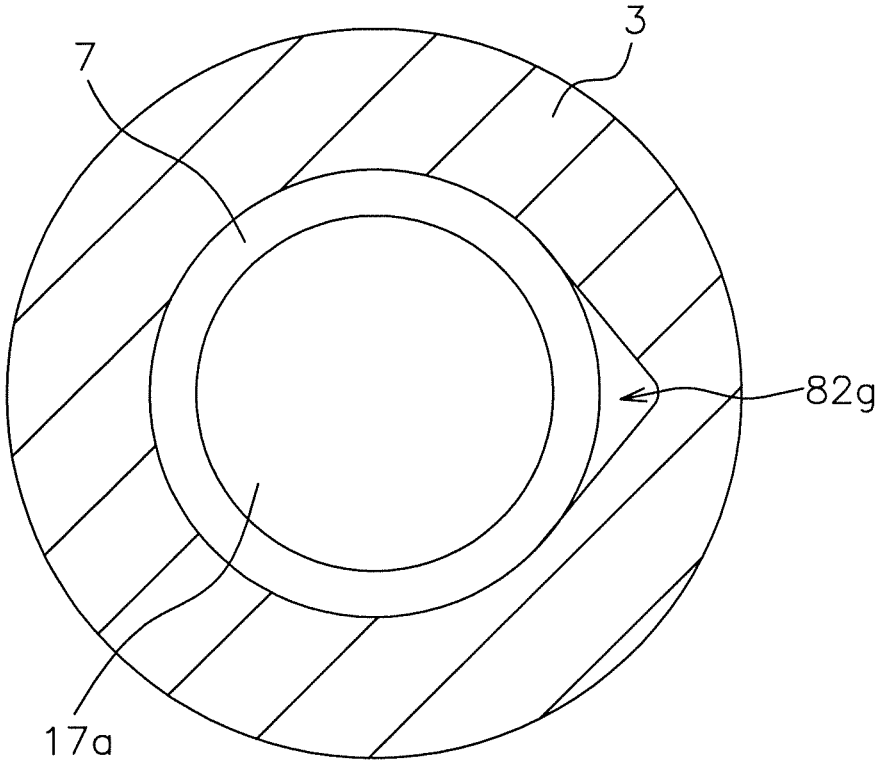
FIG. 11 is a transverse cross-sectional view of the area II of the scroll compressor according to the modification 5.
Figure 12:
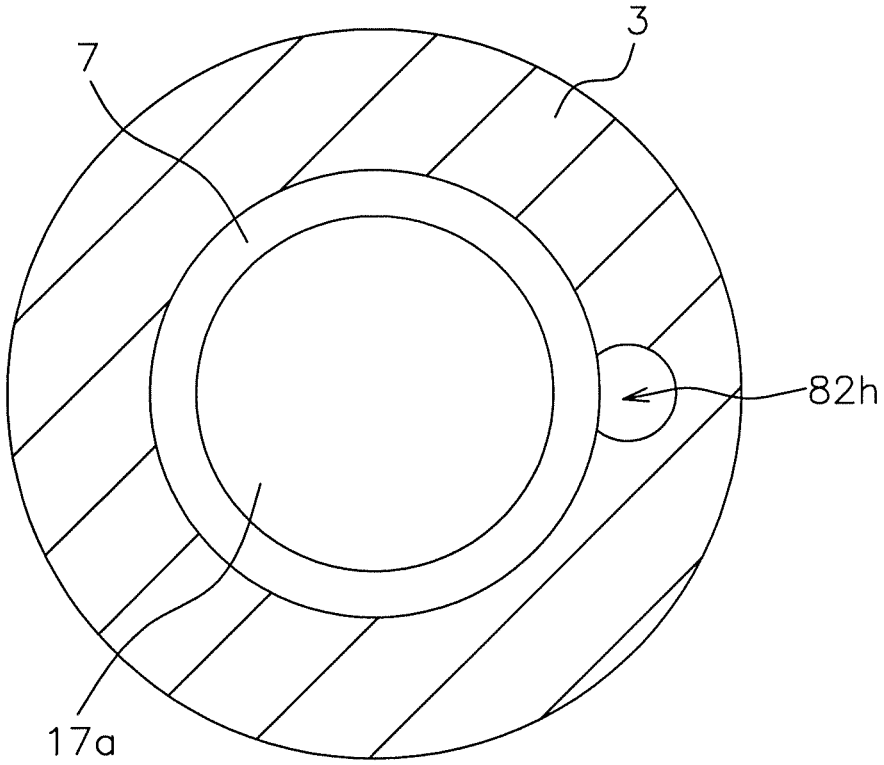
FIG. 12 is a transverse cross-sectional view of the area II of the scroll compressor according to the modification 5.

Further, the aforementioned scroll compressor 1 includes the path 82 having a semicircular cross-section (see FIG. 6). However, the cross-sectional shape of the path 82 is not particularly limited to this. For example, the scroll compressor 1 may include a path 82*f* having a crescent cross-section as illustrated in FIG. 10. Alternatively, the scroll compressor 1 may include a path 82*g* having a roughly triangular cross-section as illustrated in FIG. 11. Yet alternatively, the scroll compressor 1 may include a path 82*h* having a nearly circular cross-section as illustrated in FIG. 12.

Further, the number of and the shape of the paths may be combined as needed. In other words, the number of and the shape of the paths can be arbitrarily selected without impairing advantageous effects of the present invention.

<Modification 6>

Figure 13:
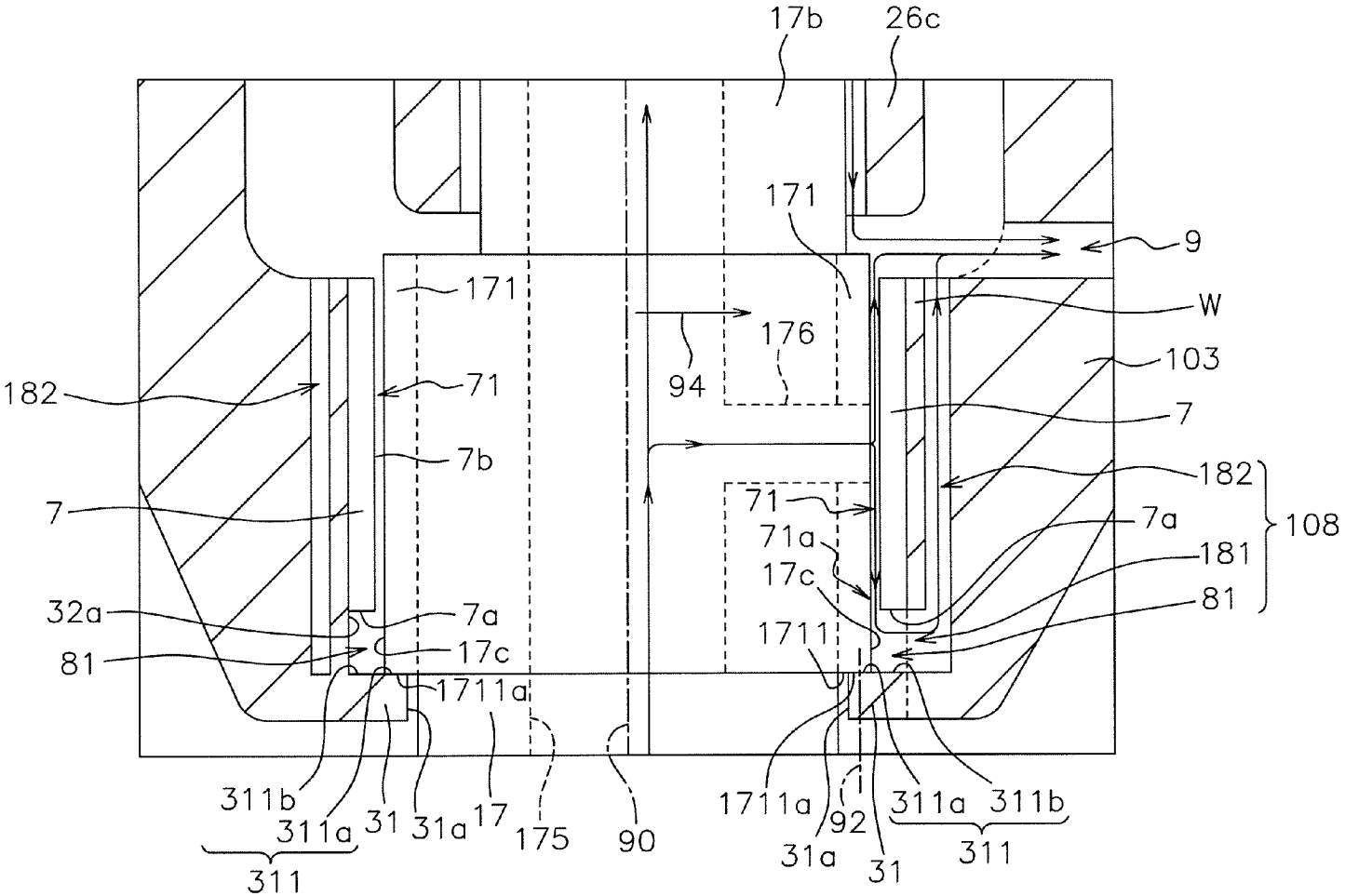
FIG. 13 is a schematic view of a scroll compressor according to a modification 6.
Figure 14:
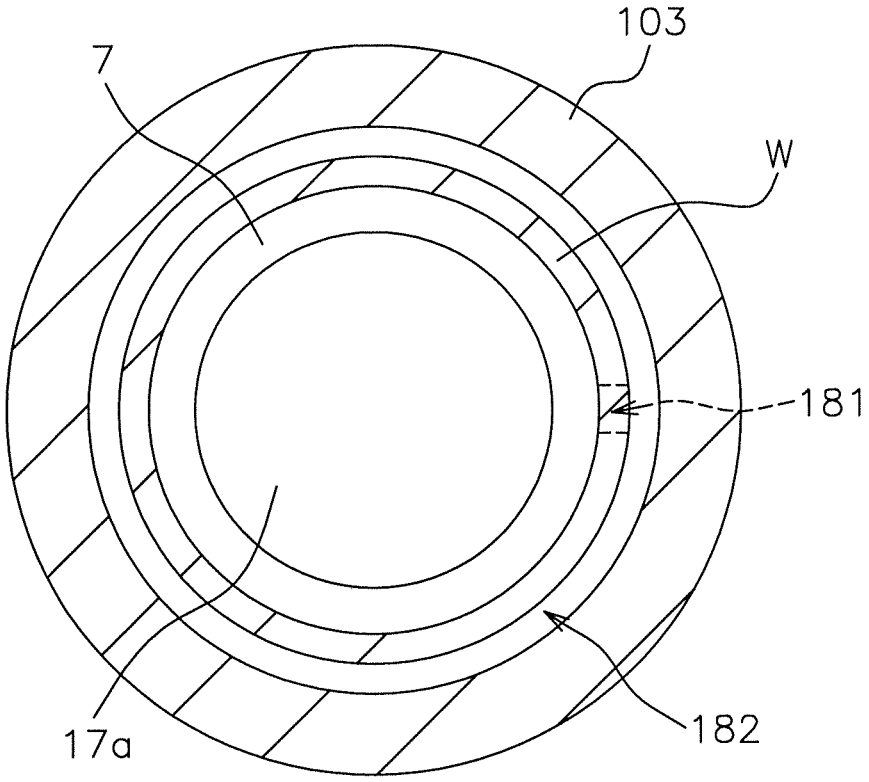
FIG. 14 is a transverse cross-sectional view of an area II illustrated in FIG. 13.

The aforementioned scroll compressor 1 includes the path 82 formed adjacent to the slide bearing 7 (see FIG. 6). As illustrated in FIGS. 13 and 14, however, a path 182 may be formed while a wall W is interposed between the path 182 and the slide bearing 7. It should be noted that the path 182 may be herein formed in an annular groove shape as illustrated in FIG. 14. Further, a through hole 181 is herein required to be formed. The through hole 181 penetrates the wall W for connecting the aperture 33 and the path 182. It should be noted in FIGS. 13 and 14 that a reference numeral 103 indicates a fixation member of the present modification whereas a reference numeral 108 indicates a recovery space of the present modification.

<Modification 7>

Figure 15:
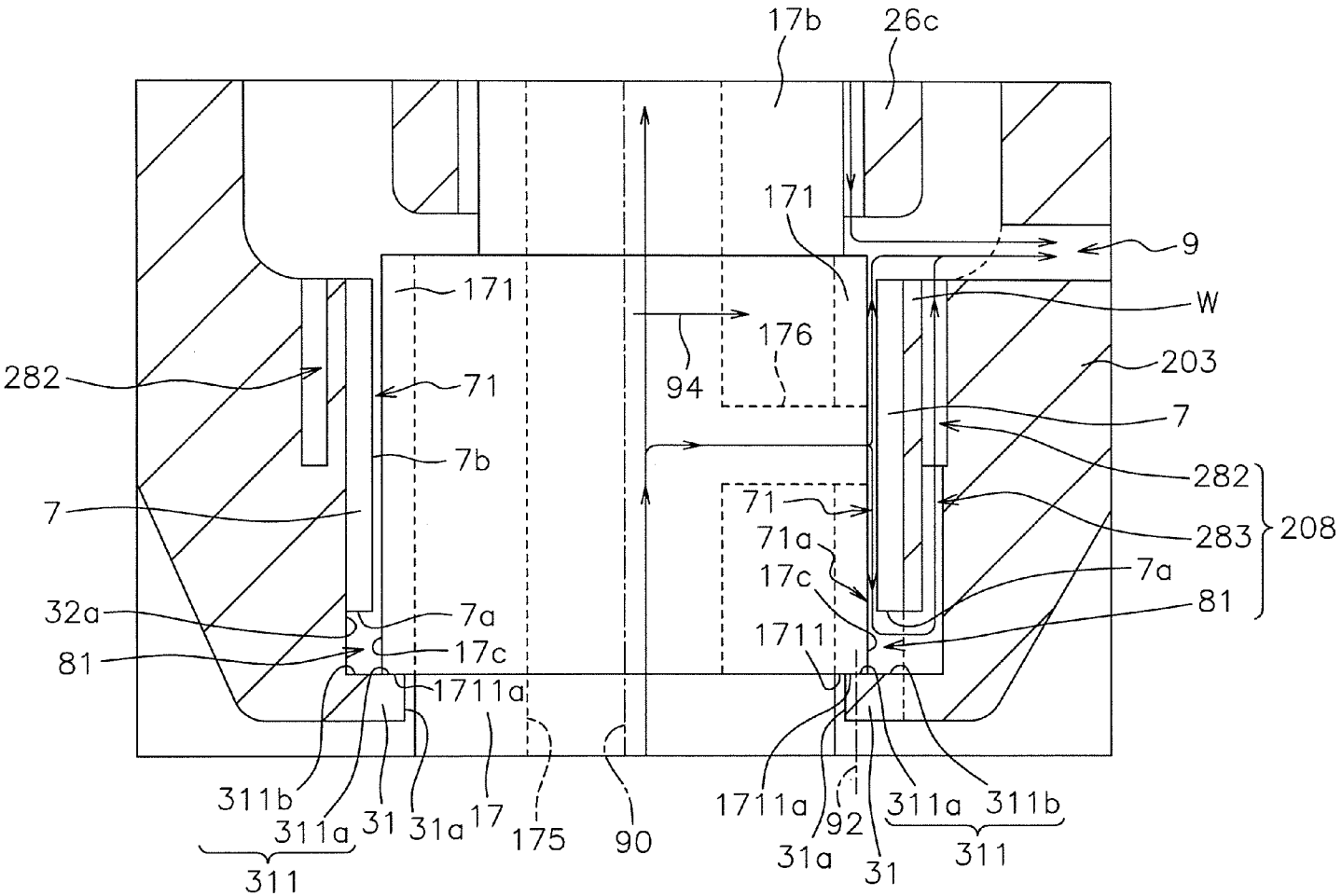
FIG. 15 is a schematic view of a scroll compressor according to a modification 7.
Figure 16:
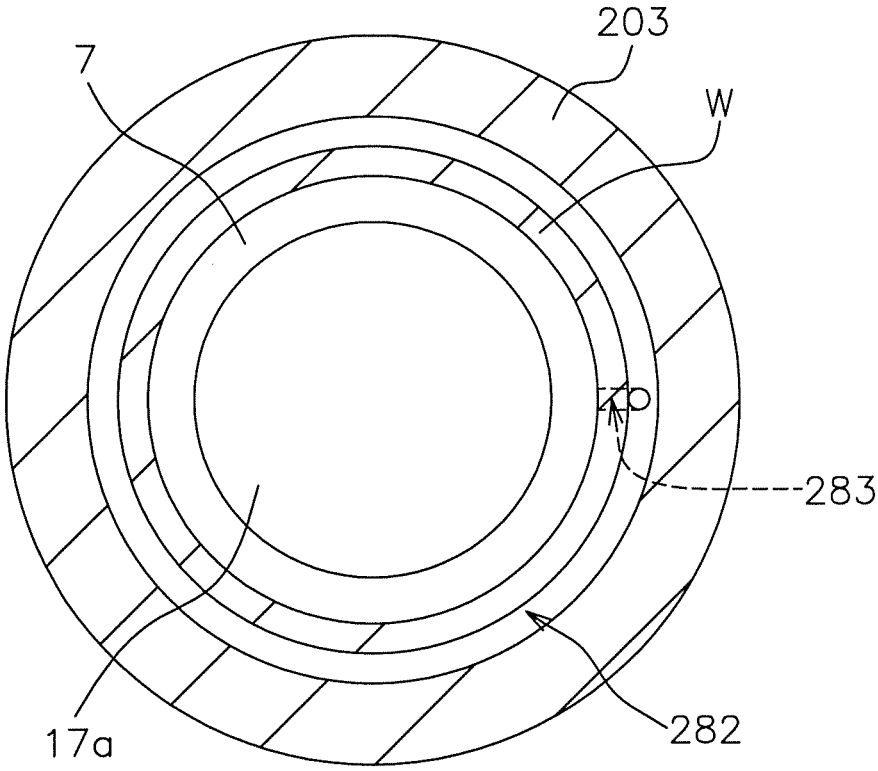
FIG. 16 is a transverse cross-sectional view of an area II illustrated in FIG. 15.

The aforementioned scroll compressor 1 includes the path 82 formed adjacent to the slide bearing 7 (see FIG. 6). As illustrated in FIGS. 15 and 16, however, a path 282 may be formed while a wall W is interposed between the path 282 and the upper part of the slide bearing 7. It should be noted that the path 282 may be herein formed in an annular groove shape as illustrated in FIG. 15. Further, a roughly L-shaped through hole 283 is herein formed. The through hole 283 penetrates the wall W for connecting the aperture 33 and the path 282. It should be noted in FIGS. 15 and 16 that a reference numeral 203 indicates a fixation member of the present modification whereas a reference numeral 208 indicates a recovery space of the present modification.

Figure 17:
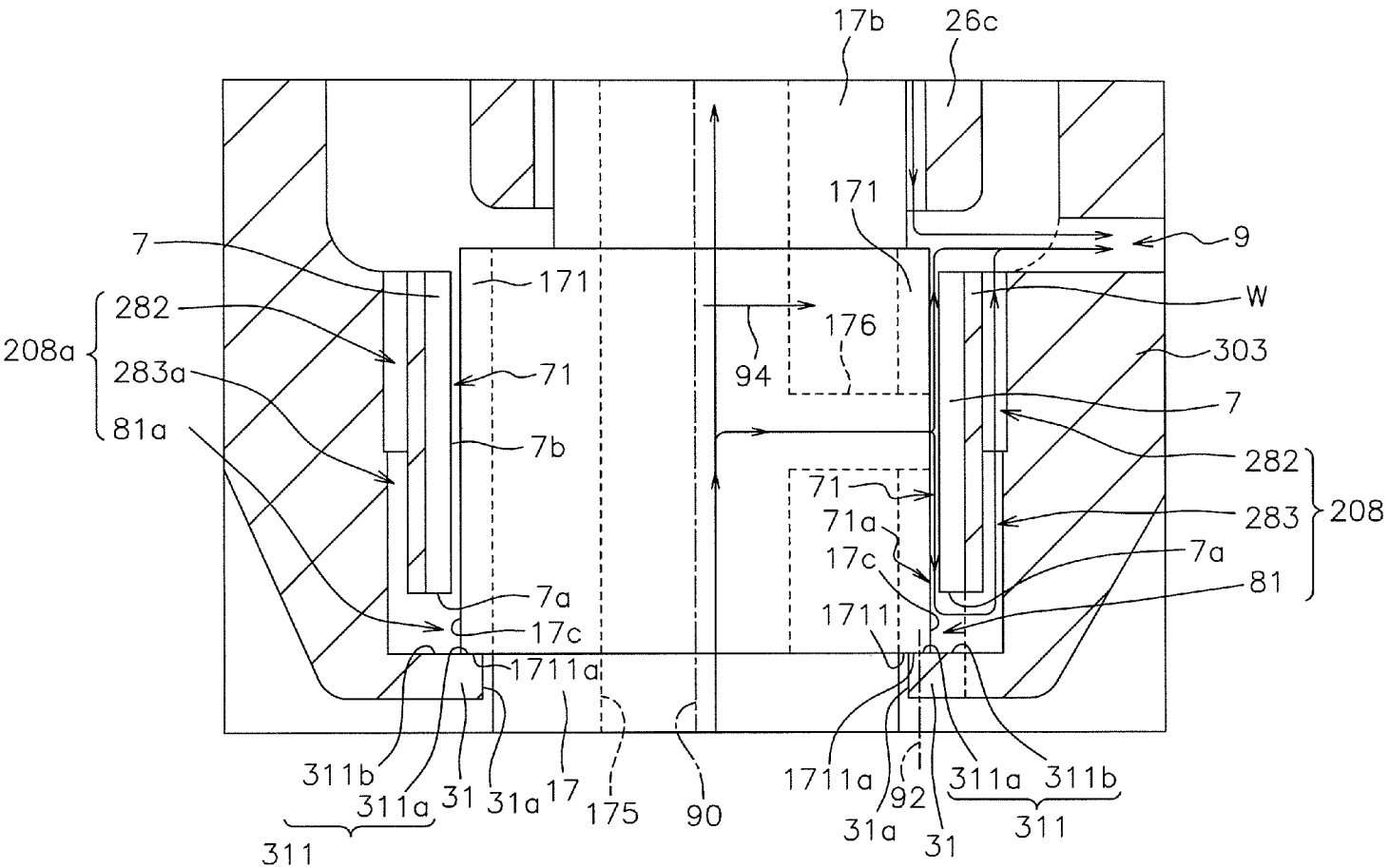
FIG. 17 is a schematic view of a scroll compressor according to another type of the modification 7.
Figure 18:
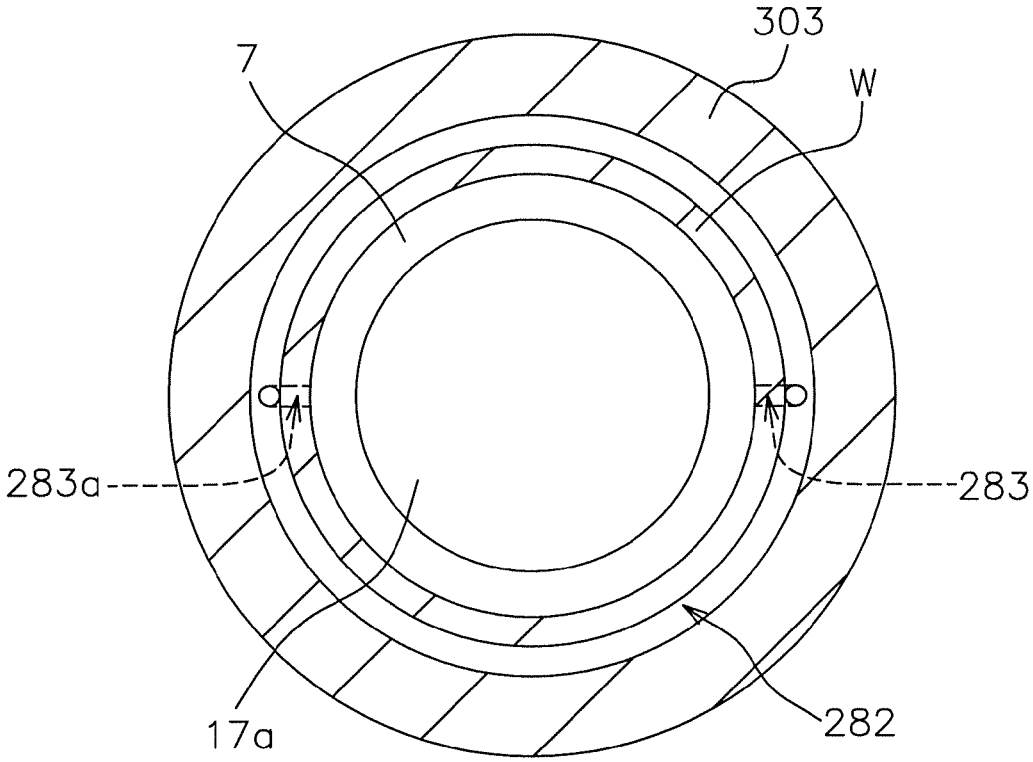
FIG. 18 is a transverse cross-sectional view of an area II illustrated in FIG. 17.

Alternatively, another roughly L-shaped through hole 283*a* may be further formed in the aforementioned modification (see FIGS. 17 and 18). It is herein further required to form a space 81*a* corresponding to the through hole 283*a*. It should be noted in FIGS. 17 and 18 that a reference numeral 303 indicates a fixation member of the present modification whereas a reference numeral 208*a* indicates a recovery space of the present modification.

It should be noted that the wall W functions as an elastic bearing in the aforementioned modifications. Therefore, the structure of the present modification contributes not only to efficient recovery of the lubricating oil but also to prevention of non-uniform/partial contact of the driving shaft 17 with respect to the slide bearing 7.

INDUSTRIAL APPLICABILITY

The compressor of the present invention is characterized to achieve, for instance, efficient recovery of the lubricating oil. Therefore, the compressor is useful as a countermeasure product for compressors having high oil leakage rates.

What is claimed is:

1. A compressor configured to compress a refrigerant and using a lubricating oil, the compressor comprising:

a compression mechanism configured to compress the refrigerant;

a driving shaft configured to rotate about a vertical rotation axis in order to drive the compression mechanism;

a slide bearing supporting the driving shaft to allow the driving shaft to slide therealong;

a fixation member with the slide bearing fixed thereon;

a circulation path formed in the compressor in order to circulate the lubricating oil therein, the circulation path being a path where the lubricating oil drawn up from a reservoir arranged at a housing of the compressor is returned to the reservoir;

a first surface fixed to the driving shaft and intersecting with a line arranged in parallel to the rotation axis;

a second surface facially abutted to the first surface; and a recovery space formed in the compressor, the recovery space being configured and arranged to recover the lubricating oil leaking out of bottom ends of sliding surfaces of the slide bearing and the driving shaft, the bottom ends of the slide bearing forming lowermost ends of the slide bearing the recovery space including a first space formed by surfaces when the driving shaft is supported by the slide bearing, the surfaces including a lateral surface of the driving shaft, the lateral surface continuing to the first surface, a bottom surface of the slide bearing, a surface continuing to the second surface, and a surface of the fixation member, the surface of the fixation member being positioned close to the driving shaft, and a second space connecting the first space and the circulation path, the second space being formed by an annular groove and a connection path, the annular groove being opposed to the slide bearing with a wall disposed therebetween, the annular groove extending upwardly from the bottom ends of the slide bearing to an uppermost free end of the slide bearing, the connection path penetrating the wall in order to connect the first space and the second space, and the first surface and the second surface respectively continuing to surfaces forming the recovery space.

2. The compressor according to claim 1, wherein the driving shaft includes a protruded portion protruding relative to the rotation axis in a radial direction, and the first surface forms at least a part of a bottom surface of the protruded portion of the driving shaft.

3. The compressor according to claim 1, wherein the fixation member includes a protruded portion protruding towards the driving shaft, the protruded portion being positioned below a part of the fixation member where the slide bearing is fixed, and the second surface forms at least a part of a top surface of the protruded portion of the fixation member.

4. The compressor according to claim 1, further comprising:

a plate fixed to the fixation member, the plate being positioned below a part of the fixation member where the slide bearing is fixed, the second surface forming at least a part of a top surface of the plate.

5. The compressor according to claim 1, wherein the surface of the fixation member positioned close to the driving shaft is retracted further away from the driving shaft than a surface of the fixation member with the slide bearing fixed thereon is.

6. The compressor according to claim 2, wherein the fixation member includes a protruded portion protruding towards the driving shaft, the protruded portion of the fixation member being positioned below a part of the fixation member where the slide bearing is fixed, and the second surface forms at least a part of a top surface of the protruded portion of the fixation member.

7. The compressor according to claim 2, further comprising:

a plate fixed to the fixation member, the plate being positioned below a part of the fixation member where the slide bearing is fixed, the second surface forming at least a part of a top surface of the plate.

* * * * *

UNITED STATES PATENT AND TRADEMARK OFFICE

CERTIFICATE OF CORRECTION

PATENT NO. : 8,641,394 B2
APPLICATION NO. : 12/867780
DATED : February 4, 2014
INVENTOR(S) : Masahiro Yamada et al.

It is certified that error appears in the above-identified patent and that said Letters Patent is hereby corrected as shown below:

Title Page,

Item (30) Foreign Application Priority Data

Change "Feb. 28, 2008 (JP).....2008-047938
Feb. 27, 2009 (JP).....2009-045513"

to --Feb. 28, 2008 (JP).....2008-047938--

Signed and Sealed this
Twentieth Day of January, 2015

Michelle K. Lee

Michelle K. Lee
*Deputy Director of the United States Patent and Trademark Office*